US011242660B1

(12) United States Patent
Makosch

(10) Patent No.: US 11,242,660 B1
(45) Date of Patent: Feb. 8, 2022

(54) PREFORMED REFLECTIVE LINE MARKING FOR ROADWAYS AND ASSOCIATED METHODS THEREOF

(71) Applicant: Preform LLC, St. Augustine, FL (US)

(72) Inventor: Steve Makosch, St. Augustine, FL (US)

(73) Assignee: PREFORM LLC, St. Augustine, FL (US)

( * ) Notice: Subject to any disclaimer, the term of this patent is extended or adjusted under 35 U.S.C. 154(b) by 173 days.

(21) Appl. No.: 16/786,879

(22) Filed: Feb. 10, 2020

Related U.S. Application Data

(60) Provisional application No. 62/803,304, filed on Feb. 8, 2019.

(51) Int. Cl.

| | |
|---|---|
| ***E01F 9/512*** | (2016.01) |
| ***E01F 9/524*** | (2016.01) |
| ***E01F 9/529*** | (2016.01) |
| ***E01F 9/576*** | (2016.01) |
| *E01F 9/582* | (2016.01) |
| *E01F 9/547* | (2016.01) |
| *E01F 9/559* | (2016.01) |

(52) U.S. Cl.
CPC ..... *E01F 9/512* (2016.02); *E01F 9/524* (2016.02); *E01F 9/529* (2016.02); *E01F 9/578* (2016.02); *E01F 9/547* (2016.02); *E01F 9/559* (2016.02); *E01F 9/582* (2016.02)

(58) Field of Classification Search
None
See application file for complete search history.

(56) References Cited

U.S. PATENT DOCUMENTS 3,844,669 A * 10/1974 Eigenmann ..... E01C 23/14 404/94
4,012,247 A * 3/1977 Eigenmann ..... E01C 23/166 156/71

(Continued)

FOREIGN PATENT DOCUMENTS

CN 109267506 A 1/2019
DE 101 28 549 A1 12/2002

(Continued)

*Primary Examiner* — Thomas B Will
*Assistant Examiner* — Katherine J Chu
(74) *Attorney, Agent, or Firm* — Jack D. Stone, Jr.; Scheef & Stone, L.L.P.

(57) ABSTRACT

A preformed thermoplastic roadway line marking includes a preformed thermoplastic substrate layer capable of being attached to a roadway, and a preformed thermoplastic upper layer in contact with the substrate layer. Advantageously, such an upper layer includes a surface area having a plurality of spaced-apart slits. The slits penetrate through an entire cross-sectional thickness of the upper layer and are in fluid communication with the substrate layer. When heated to a liquid state, the substrate layer has a morphed shape and is at least partially displaced upwardly through the slits and disposed on the upper layer such that the upper layer is fixedly locked to the substrate layer and maintained at a substantially stable position relative to the substrate layer. Such a structural configuration provides an unexpected and unpredictable result of insuring the marking is locked into place relative to the roadway, thereby reducing labor costs and improving durability.

15 Claims, 9 Drawing Sheets

(56) References Cited

U.S. PATENT DOCUMENTS 4,071,384 A * 1/1978 Eigenmann ..... E01C 23/185 118/202
4,129,397 A * 12/1978 Eigenmann ..... E01F 9/578 404/14
4,708,518 A 11/1987 Eigenmann
5,039,557 A * 8/1991 White ..... E01C 23/166 427/137
5,536,569 A * 7/1996 Lasch ..... E01F 9/512 428/328
6,576,074 B1 * 6/2003 Cabrera ..... E01F 9/512 156/71
6,703,108 B1 3/2004 Bacon, Jr. et al.
6,960,989 B1 11/2005 Grayson
7,066,680 B2 6/2006 Wiley
7,189,025 B1 3/2007 Greer et al.
7,465,693 B2 12/2008 Greer et al.
7,645,502 B2 1/2010 Greer et al.
8,317,956 B2 11/2012 Greer
8,573,882 B2 11/2013 Greer et al.
8,864,409 B2 10/2014 Parker
9,163,368 B2 * 10/2015 Asgari ..... E01F 9/506
11,112,498 B2 * 9/2021 Miu ..... B60W 40/04
2008/0090008 A1 * 4/2008 Julnes ..... A61H 3/066 427/256
2008/0166181 A1 * 7/2008 Pilate ..... E01F 9/578 404/9
2008/0182016 A1 * 7/2008 Wiley ..... E01C 23/028 427/136
2008/0232903 A1 9/2008 Ogemark et al.
2010/0055374 A1 3/2010 Greer et al.
2010/0226717 A1 * 9/2010 Bjorklund ..... E01F 9/518 404/16
2010/0288949 A1 * 11/2010 Yoo ..... F16K 99/0001 251/65
2011/0059295 A1 3/2011 Greer et al.
2012/0092767 A1 * 4/2012 Naik ..... E01F 9/524 359/547
2016/0166437 A1 * 6/2016 Lundh ..... A61F 13/00059 602/76
2017/0306576 A1 10/2017 Greer et al.
2017/0367899 A1 * 12/2017 Lundh ..... A61F 13/08
2019/0139413 A1 * 5/2019 Austin ..... G08G 1/08
2019/0234032 A1 * 8/2019 Lowe ..... E01F 9/578
2020/0283974 A1 * 9/2020 Ennet ..... E01F 9/512
2020/0347562 A1 * 11/2020 Wilkins ..... C08L 75/04

FOREIGN PATENT DOCUMENTS

EP 3 311 976 A1 4/2018
WO 2015/019105 A1 2/2015
WO 2015/053743 A2 4/2015

* cited by examiner

PREFORMED REFLECTIVE LINE MARKING FOR ROADWAYS AND ASSOCIATED METHODS THEREOF

CROSS-REFERENCE TO RELATED APPLICATIONS

This application claims the benefit of U.S. Provisional Application No. 62/803,304 filed Feb. 8, 2019, which application is hereby incorporated herein by reference, in its entirety.

TECHNICAL FIELD

Exemplary embodiment(s) of the present disclosure relates to roadway line markings, more particularly, to product(s) and method(s) that succinctly facilitate installation (locking) of preformed thermoplastic reflective roadway line markings without heating a preformed thermoplastic upper layer, thereby reducing installation costs and improving durability.

BACKGROUND OF THE DISCLOSURE

Pavement markings convey information to drivers and pedestrians by providing exposed visible, reflective and/or tactile surfaces that serve as indicia upon a traffic surface. In the past, such a function was typically accomplished by painting a traffic surface. Modern pavement marking materials offer significant advantages over paint such as dramatically increased visibility and/or retro-reflectance, improved durability, and temporary removable marking options. Examples of modern pavement marking materials are thermoplastic, pavement marking sheet materials, tapes and raised pavement markers.

Such thermoplastic materials may incorporate reflective glass particles additives, which may automatically be incorporated in the final pre-formed marking. However, it has been found that the heating of the preformed thermoplastic material with the additives, followed by subsequent pouring and setting tends to cause the integral glass particles to settle down in the bottom region of the marking.

In recent years, the industry has utilized preformed thermoplastic pavement markings with various patterns and designs to guide, decorate and protect high traffic areas such as highways, pedestrian crosswalks, parking lots and business entrances. Such a preformed planar thermoplastic sheet or strip can have varying thicknesses and widths that vary with the purpose of the marking. Such marking patterns must be carefully assembled and handled before applying to pavements such as asphalt, concrete or other suitable roadways. These marking patterns are placed at desired locations such as road crosswalks, intersections, parking lots or other sites. Heat is then carefully applied to soften the pavement marking pattern causing it to firmly adhere to the roadway. Various adhesives can also be used to adhere the marking pattern to the substrate. Unfortunately, too much heat damages the desirable retro-reflective characteristics and durability of the pavement marking pattern, as well as increases labor costs.

As appreciated by those skilled in the art, much time and labor is devoted to the assembly and application of the marking patterns to the roadway. Most marking patterns consist of two or more sections which are independently formed for manual assembly at the job site and time and effort is needed to assemble and maintain the integrity of a pattern before the heat treatment.

Accordingly, a need remains for product(s) and method(s) for locking a preformed thermoplastic substrate layer with a preformed thermoplastic upper layer during installation of a reflective roadway line mark in order to overcome at least one of the above-noted shortcomings.

SUMMARY

According to the present invention, an exemplary embodiment(s) thereof satisfies such a need by a preformed, multi-layered thermoplastic configuration that is convenient and easy to use, lightweight yet durable in design, versatile in its applications, and designed to succinctly facilitate installation (locking) of preformed thermoplastic, reflective roadway line markings without heating a preformed thermoplastic upper layer, thereby reducing installation costs and improving durability.

More specifically, a preformed thermoplastic roadway line marking includes a preformed thermoplastic substrate layer capable of being attached to a roadway, and a preformed thermoplastic upper layer in contact with the preformed thermoplastic substrate layer. Advantageously, such a preformed thermoplastic upper layer includes a surface area having a plurality of spaced-apart slits. The slits penetrate through an entire cross-sectional thickness of the preformed thermoplastic upper layer and are in fluid communication with the preformed thermoplastic substrate layer. When heated to a liquid state, the preformed thermoplastic substrate layer has a morphed shaped and is at least partially displaced upwardly through the slits and disposed on the preformed thermoplastic upper layer such that the preformed thermoplastic upper layer is fixedly locked to the preformed thermoplastic substrate layer and maintained at a substantially stable position relative to the preformed thermoplastic substrate layer. Such a structural configuration provides an unexpected and unpredictable result of insuring that the preformed thermoplastic roadway line marking is locked into place relative to the roadway, and thereby reduces labor costs and improves durability.

In a method for installing a preformed thermoplastic roadway line marking, a preformed thermoplastic substrate layer is provided and attached to a roadway by heating the preformed thermoplastic substrate layer to a liquid state such that the preformed thermoplastic substrate layer has a morphed shape. A preformed thermoplastic upper layer is provided and contacted with the preformed thermoplastic substrate layer, the preformed thermoplastic upper layer including a surface area having a plurality of spaced slits, wherein the slits penetrate through an entire cross-sectional thickness of the preformed thermoplastic upper layer. A downward external force is applied on the preformed thermoplastic upper layer such that the slits are in fluid communication with the liquid state of the preformed thermoplastic substrate layer. The preformed thermoplastic upper layer is fixedly locked to the preformed thermoplastic substrate layer, and the preformed thermoplastic upper layer is maintained at a substantially stable position relative to the preformed thermoplastic substrate layer by at least partially displacing upwardly the morphed shape of the preformed thermoplastic substrate layer through the slits and thereby disposing the morphed shape of the preformed thermoplastic substrate layer on the preformed thermoplastic upper layer.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE SEVERAL VIEWS OF THE DRAWING

For a more complete understanding of the present invention, and the advantages thereof, reference is now made to the following descriptions taken in conjunction with the accompanying drawings, in which.

DETAILED DESCRIPTION OF THE DISCLOSURE

Figure 2:
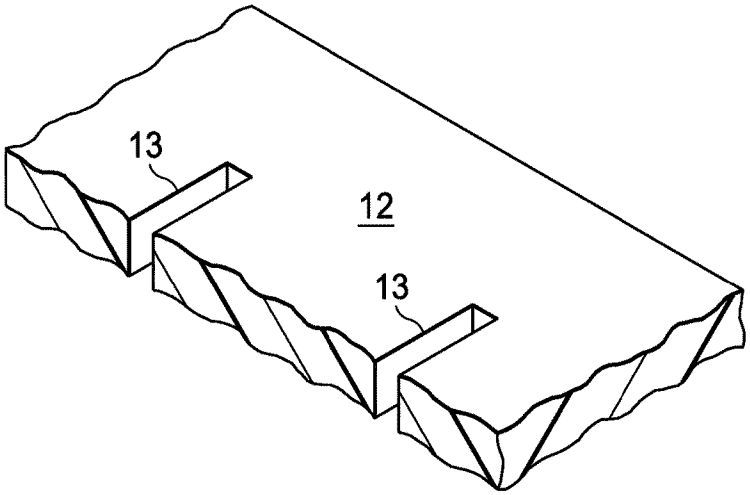
FIG. 2 depicts a portion of FIG. 1 taken along the line 2-2 of FIG. 1.

The non-limiting exemplary embodiment(s) will now be described more fully hereinafter with reference to the accompanying drawings, in which a preferred embodiment of the disclosure is shown. Such exemplary embodiment(s) may, however, be embodied in many different forms and should not be construed as limited to the embodiment set forth herein. Rather, these embodiment(s) are provided so that this application will be thorough and complete, and will fully convey the true scope of the disclosure to those skilled in the art.

The below disclosed subject matter is to be considered illustrative, and not restrictive, and any appended claim(s) are intended to cover all such modifications, enhancements, and other embodiment(s) which fall within the true scope of the non-limiting exemplary embodiment(s). Thus, to the maximum extent allowed by law, the scope of the non-limiting exemplary embodiment(s) is to be determined by the broadest permissible interpretation of the claim(s) and their equivalents, and preferably not be restricted or limited by the foregoing detailed description.

References in the specification to "an exemplary embodiment", "an embodiment", "a preferred embodiment", "an alternative embodiment" and similar phrases mean that a particular feature, structure, or characteristic described in connection with the embodiment(s) is included in at least an embodiment of the disclosure. The appearances of the phrase "a non-limiting exemplary embodiment" in various places in the specification are not necessarily all meant to refer to the same embodiment.

If used herein, "about" means approximately or nearly and in the context of a numerical value or range set forth means ±15% of the numerical.

If used herein, "substantially" means largely if not wholly that which is specified but so close that the difference is insignificant.

A non-limiting exemplary embodiment(s) of the present disclosure is referred to generally in the figures and is intended to provide product(s) and method(s) that succinctly facilitate installation (locking) of preformed thermoplastic line markings without heating a preformed thermoplastic upper layer, thereby reducing installation costs and improving durability. It should be understood that the exemplary embodiment(s) may be used to install and display a variety of preformed thermoplastic roadway line markings (marking), and should not be limited to any particular marking described herein. The thermoplastic material is preferably a polymer resin that may be extruded to form a permanent, reflective, road marking, such material being exemplified as conforming to, or exceeding, AASHTO designation M249, except for the relevant differences due to the material being supplied in a preformed state. Material is discussed in further detail below.

It will be appreciated that the term "preformed thermoplastic line marking," "marking," "roadway line marking," and variations thereof may be interchangeably used throughout the present disclosure. Such a preformed thermoplastic line marking may be installed on airport runways, automobile roadways, asphalt surface, concrete surface, and other suitable surfaces. The marking can be bonded to a road surface by the application of heat sufficient to melt a preformed thermoplastic substrate layer without heating and distorting a preformed thermoplastic upper layer and without requiring use of a separate adhesive to bond the lower substrate layer to the upper layer.

The term PREFORM™ is a proprietary mark owned by Preform, LLC having an office in St. Augustine, Fla., and it used throughout this disclosure to identify a preformed polymer thermoplastic line marking for use on roadways (pavements).

Figure 1:
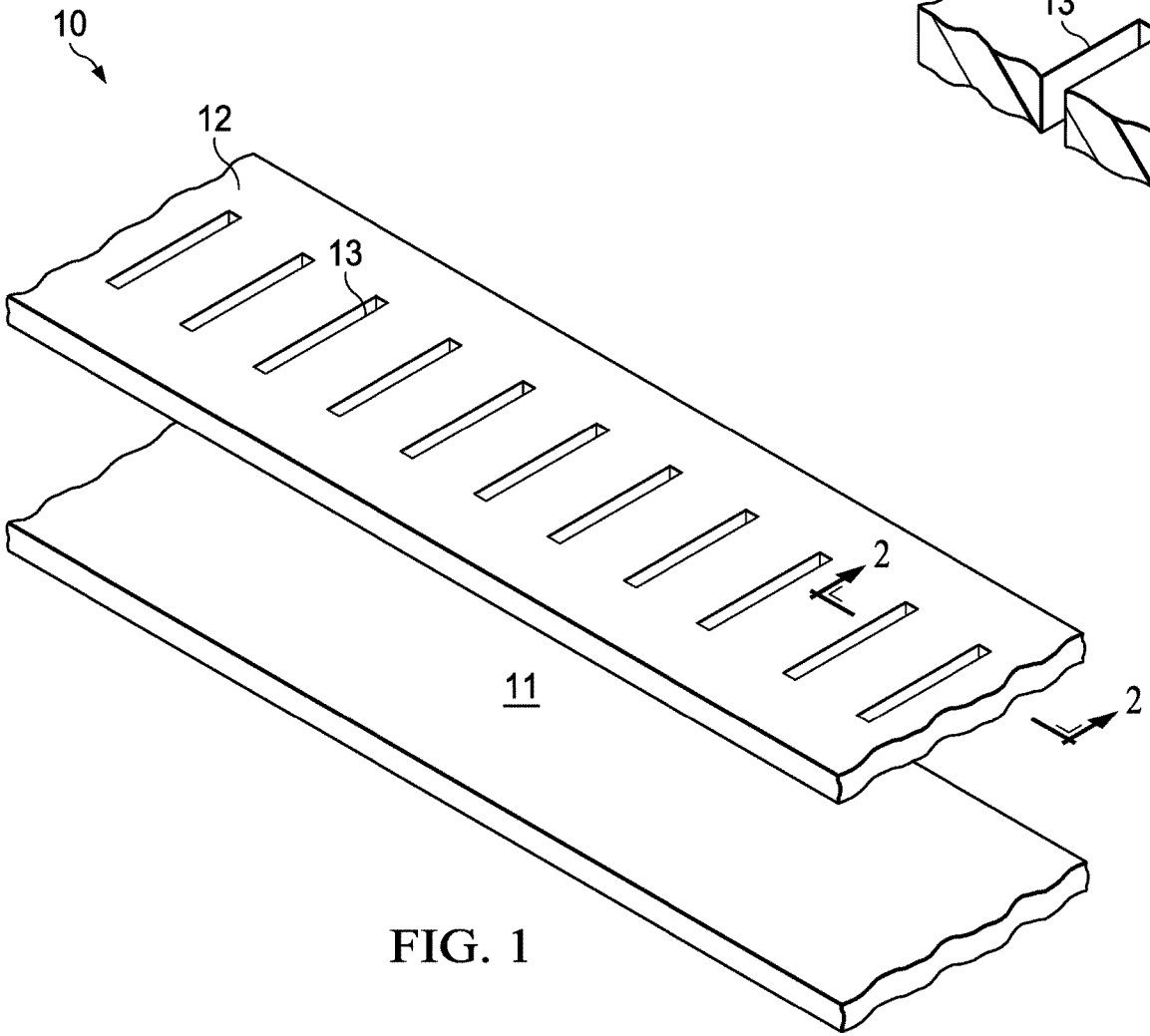
FIG. 1 exemplifies upper and lower layers of preformed thermoplastic roadway line markings embodying features of the present invention.
Figure 3:
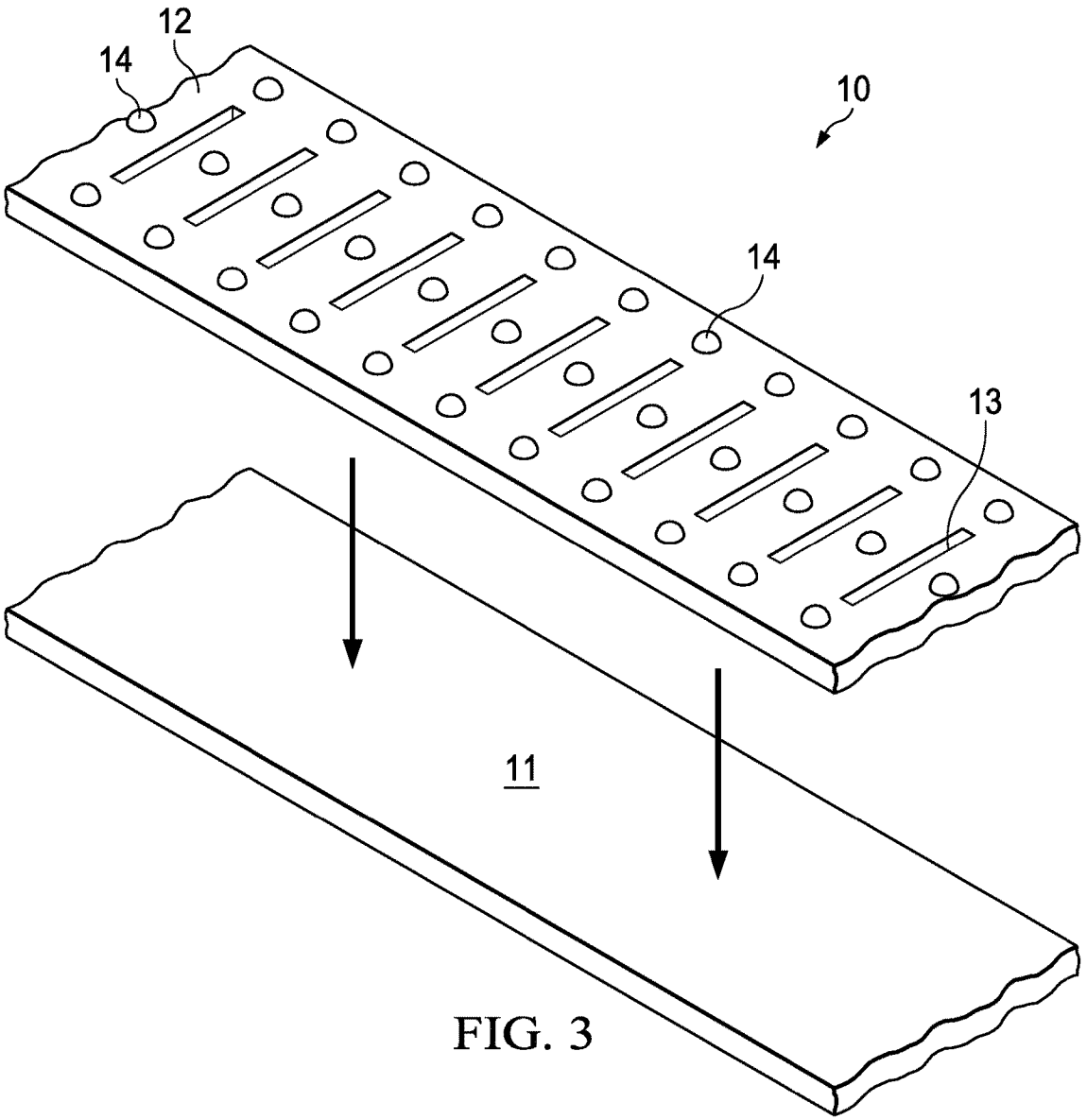
FIG. 3 exemplifies an embodiment of the invention including raised dimples 14 to alert drivers when crossing a marking, in accordance with principles of the invention.
Figure 4:
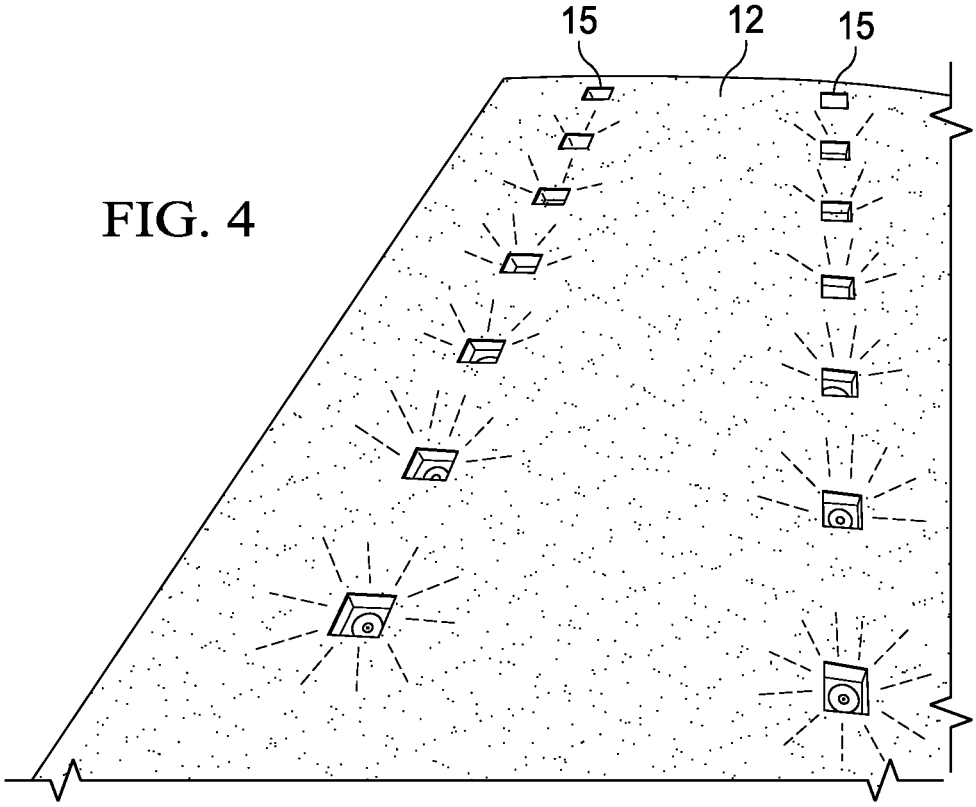
FIG. 4 exemplifies an embodiment having markings with LED's 15.
Figure 5:
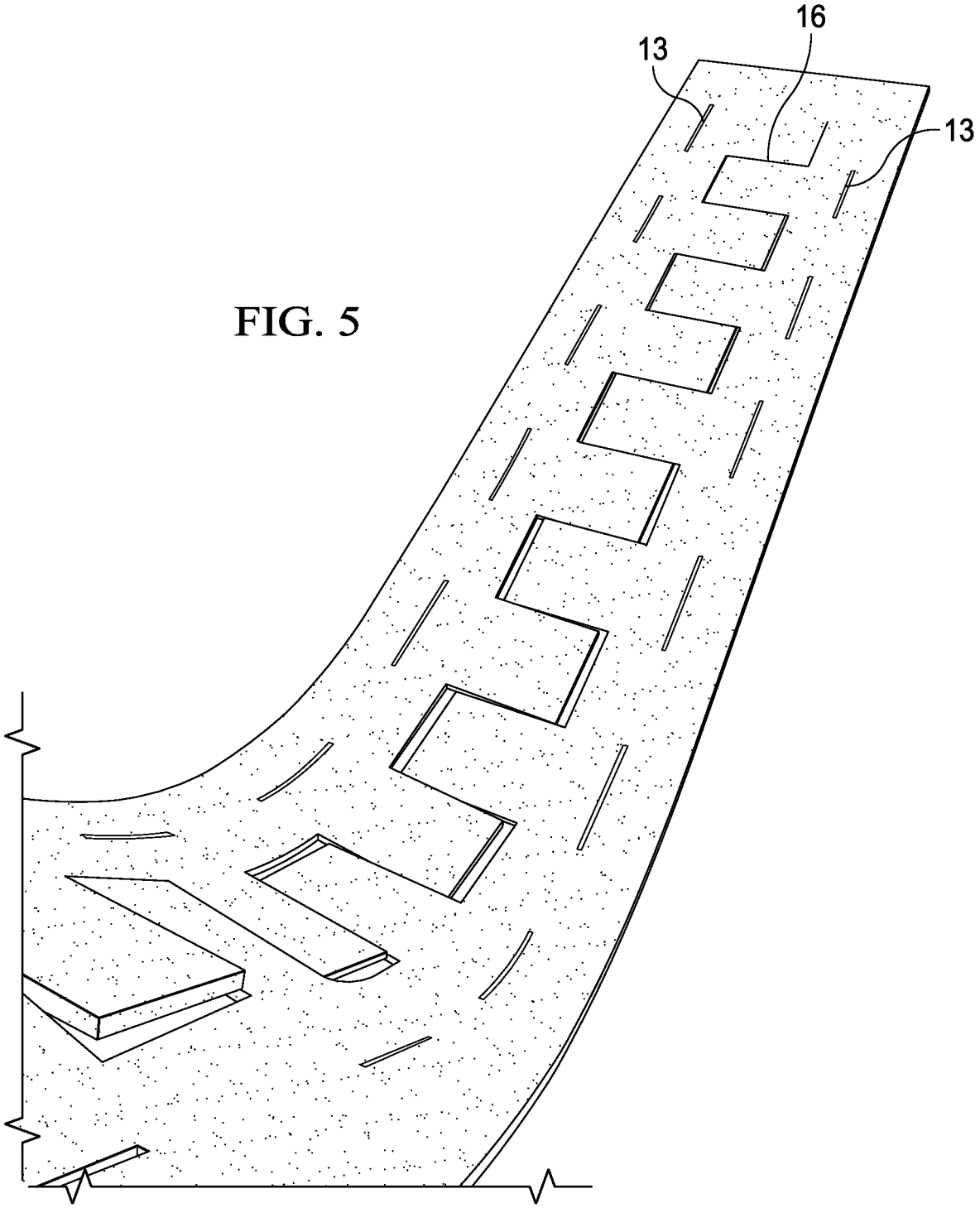
FIG. 5 exemplifies how slits, such as designated by reference numerals 13 and 16, may assume varied shapes.

Referring to FIGS. 1-3 in general, in a non-limiting exemplary embodiment(s), the preformed thermoplastic roadway line marking is designated by the reference numeral 10 and includes a preformed thermoplastic substrate layer 11 capable of being attached to a roadway, and a preformed thermoplastic upper layer 12 in contact with the preformed thermoplastic substrate layer 11. Advantageously, such a preformed thermoplastic upper layer 12 includes a surface area having a plurality of spaced-apart slits 13. Slits 13 penetrate through an entire cross-sectional thickness of preformed thermoplastic upper layer 12 and are in fluid communication with preformed thermoplastic substrate layer 11. When heated to a liquid state, preformed thermoplastic substrate layer 11 assumes a morphed shaped and is at least partially displaced upwardly through slits 13 and disposed on preformed thermoplastic upper layer 12 such that preformed thermoplastic upper layer 12 is fixedly locked, or secured, to preformed thermoplastic substrate layer 11 and maintained at a substantially stable position relative to preformed thermoplastic substrate layer 11. Such a structural configuration provides an unexpected and unpredictable result of insuring the preformed thermoplastic roadway line marking is locked, or secured, into place relative to the roadway, and thereby reduces labor costs and improves durability.

In a non-limiting exemplary embodiment, preformed thermoplastic upper layer 12 preferably has a non-morphed predetermined shape.

In a non-limiting exemplary embodiment, slits 13 preferably include rectilinear slits. By way of example, but not limitation, a rectilinear slit may be up to about 0.125 inches (0.3175 cm) wide and about 2 inches (5 cm) long. It can be appreciated that slots are suitably spaced-apart and may be straight or curved (arcuate).

In a non-limiting exemplary embodiment, preformed thermoplastic upper layer 12 further preferably includes an aperture juxtaposed adjacent to slits 13.

In a non-limiting exemplary embodiment, preformed thermoplastic roadway line marking 10 further includes an image layer affixed to preformed thermoplastic substrate layer 11 and seated within the aperture.

In a non-limiting exemplary embodiment, the image layer is one of a uni-directional image layer and a bi-directional image layer.

In a non-limiting exemplary embodiment, slits 13 are arranged in a desired configuration and surround the aperture.

In a non-limiting exemplary embodiment, at least one of the preformed thermoplastic substrate layer 11 and the preformed thermoplastic upper layer 12 includes a plurality of retro-reflective glass beads, discussed in further detail below.

Figure 6:
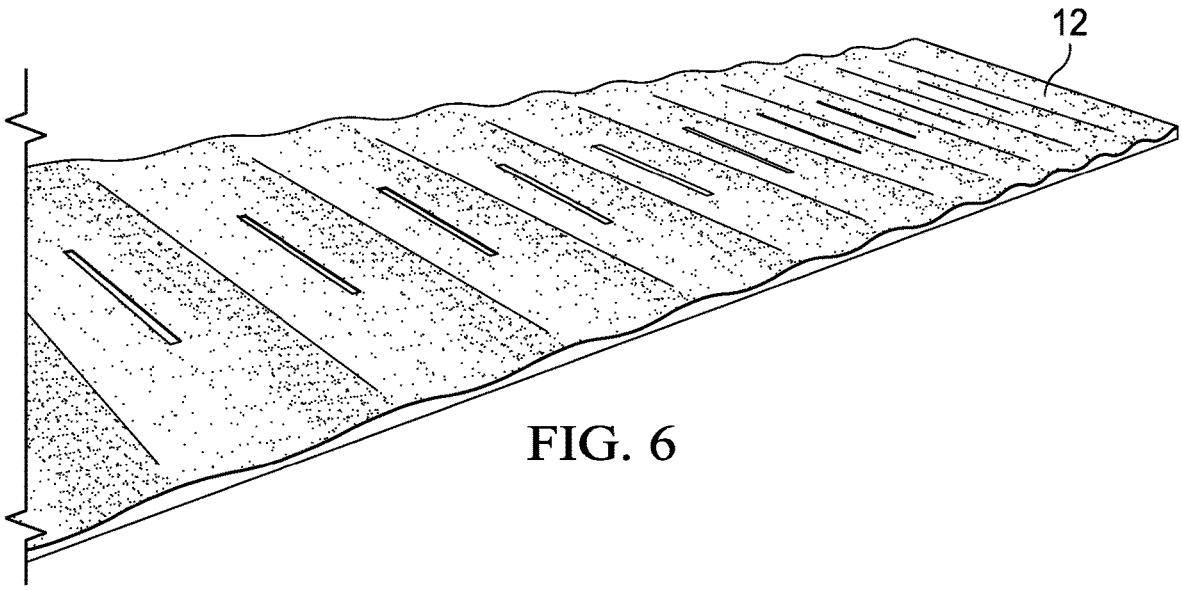
FIG. 6 exemplifies an embodiment of the invention including bumps to alert drivers when crossing a marking, in accordance with principles of the invention.
Figure 7:
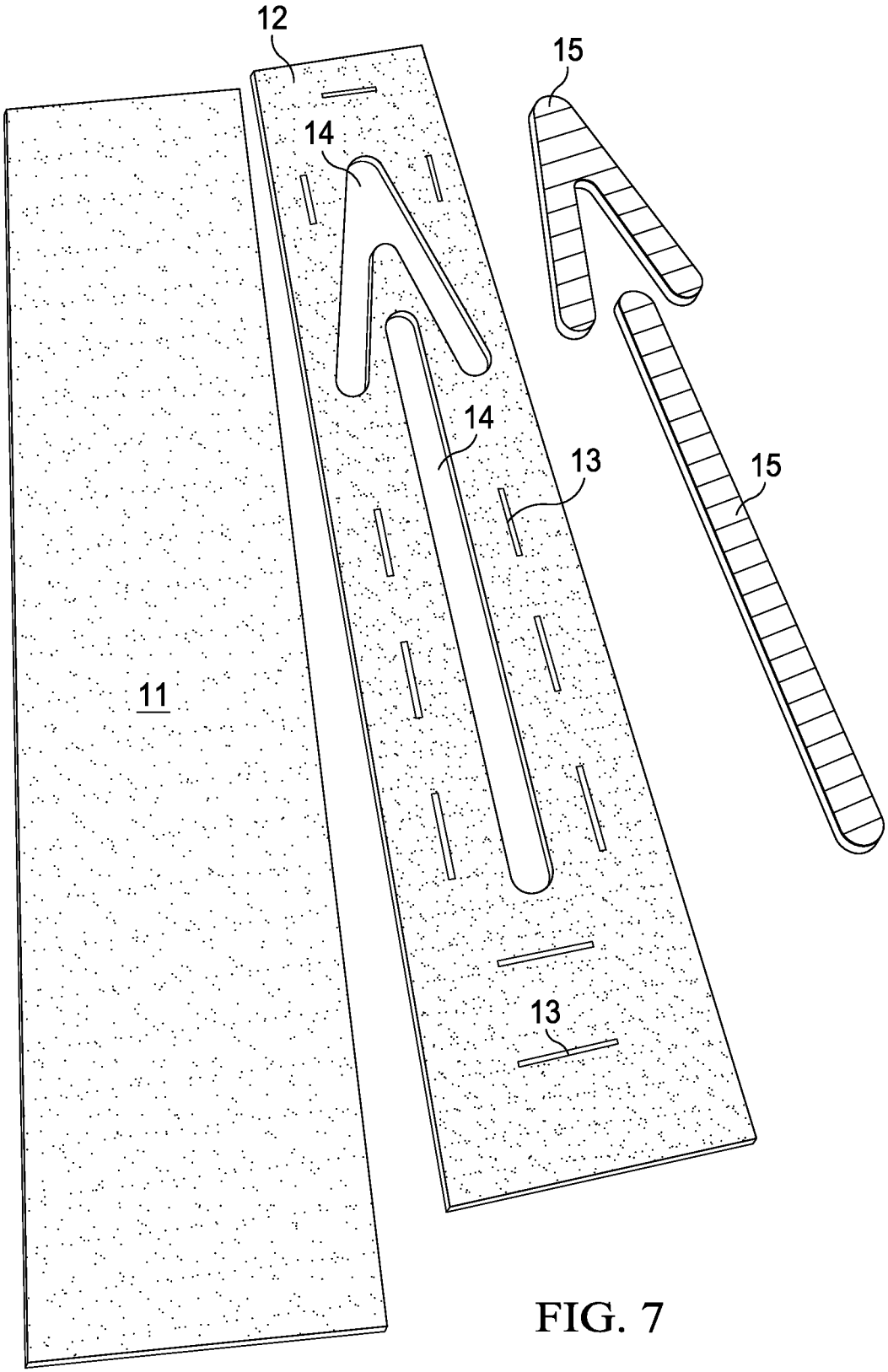
FIGS. 7 and 8 exemplify a preformed thermoplastic roadway line marking having an arrow 15 positioned in cut-out 14, the arrow reflecting to drivers traveling in one direction, in accordance with principles of the invention.
Figure 8:
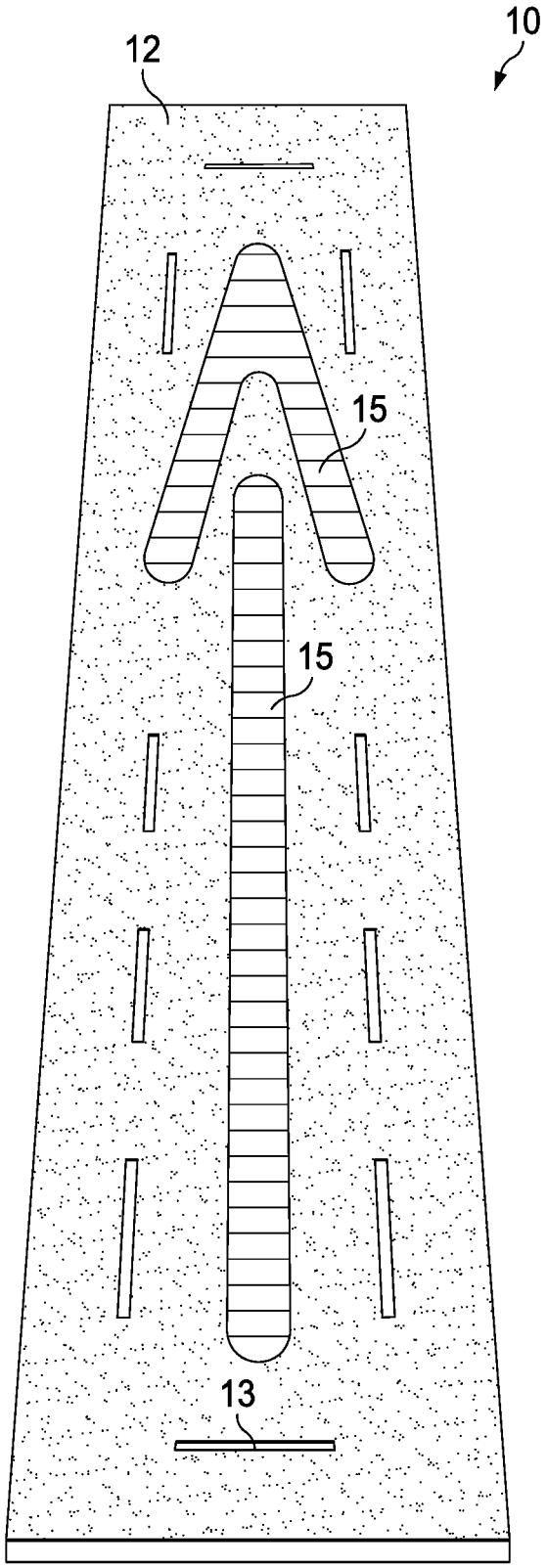
Figure 9:
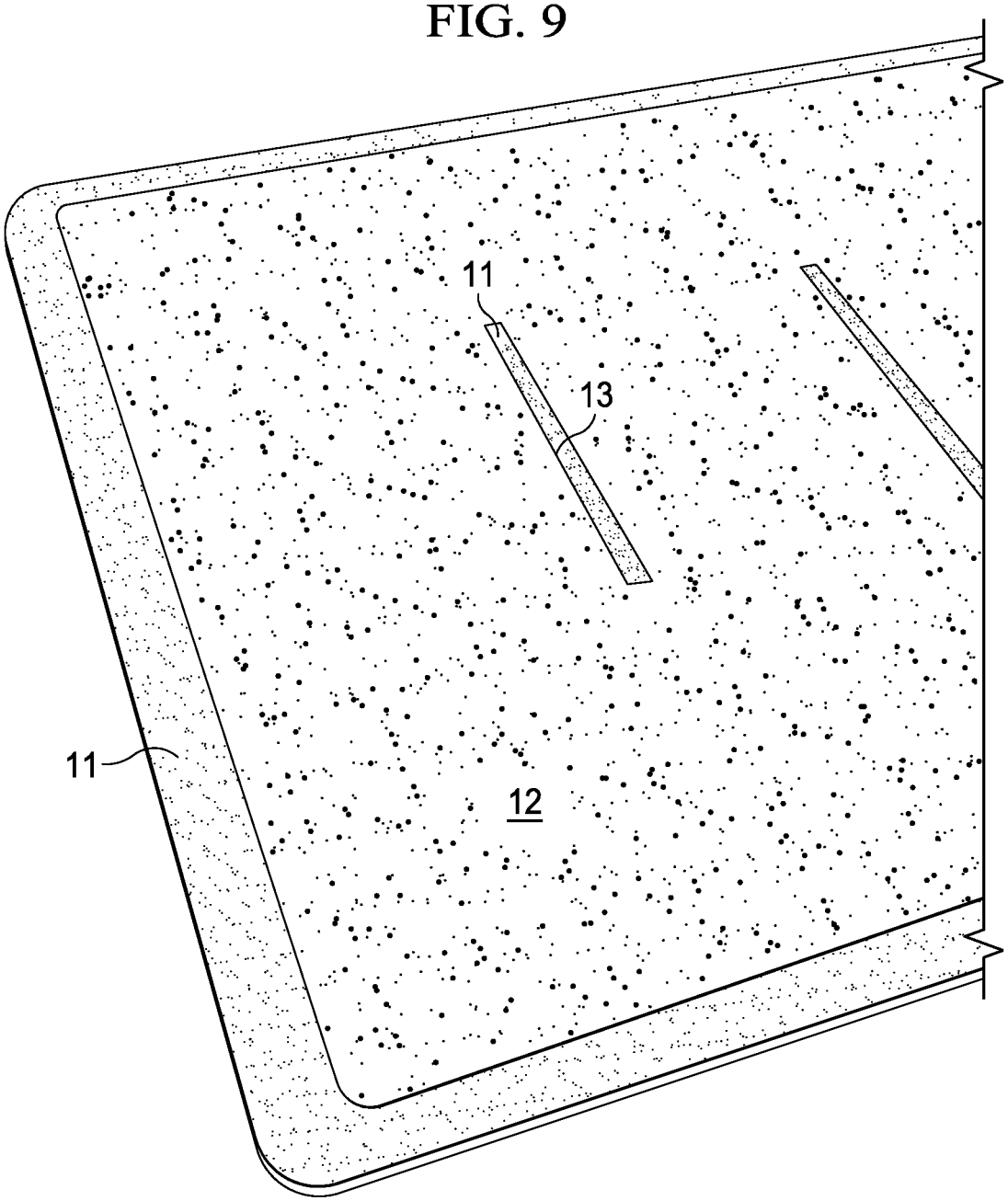
FIG. 9 exemplifies upper layer slots into which lower layer material has morphed in accordance with principles of the invention.

In a non-limiting exemplary embodiment, preformed thermoplastic upper layer 12 has a substantially planar top surface or a non-planar top surface, the latter exemplified by at least one pattern selected from a group including a corrugated pattern, a sinusoidal pattern (FIG. 6), a hatching pattern, and a ribbed pattern.

Figure 10:
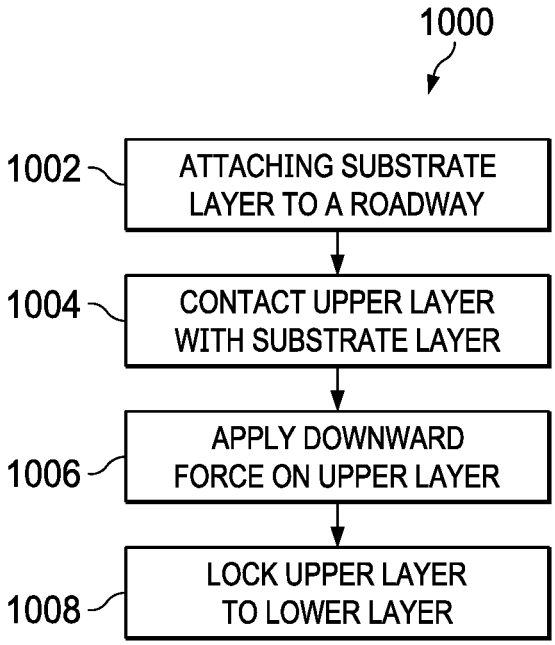
FIG. 10 depicts a flow chart illustrating steps embodying features of the present invention for installing preformed thermoplastic roadway line markings.

The present disclosure further includes a method for installing preformed thermoplastic roadway line marking 10 by adhering preformed thermoplastic substrate layer 11 to a roadway, and thermally bonding preformed thermoplastic upper layer 12 to preformed thermoplastic substrate layer 11. Accordingly, FIG. 10 illustrates a flow chart 1000 depicting the following steps of such a method as follows:

In step 1002, preformed thermoplastic substrate layer 11 is adhered to a roadway (e.g., such as asphalt and concrete pavements and Portland cement concrete pavements) by heating (preferably by the use of a propane torch) preformed thermoplastic substrate layer 11 to a molten or liquid state such that preformed thermoplastic substrate layer 11 assumes a morphed shape that conforms and fuses to, and thereby adhering to, the road surface.

In step 1004, preformed thermoplastic upper layer 12 is contacted with the preformed thermoplastic substrate layer 11. Preformed thermoplastic upper layer 12 includes a surface area having a plurality of spaced-apart slits 13, wherein slits 13 penetrate through an entire cross-sectional thickness of preformed thermoplastic upper layer 12.

In step 1006, a downward external force is applied onto preformed thermoplastic upper layer 12 such that slits 13 are in fluid communication with the liquid state of preformed thermoplastic substrate layer 11.

In step 1008, preformed thermoplastic upper layer 12 is fixedly locked (i.e., thermally bonded) to preformed thermoplastic substrate layer 11, and preformed thermoplastic upper layer 12 is maintained at a substantially stable position relative to preformed thermoplastic substrate layer 11 by at least partially displacing upwardly the morphed shape of preformed thermoplastic substrate layer 11 through slits 13 and thereby disposing the morphed shape of preformed thermoplastic substrate layer 11 on preformed thermoplastic upper layer 12.

Markings 10 are suitable to use for roadway, intersection, commercial or private pavement delineation and markings. Markings 10 are preferably designed for straight lines, arrows, symbols, legends, letters/numbers and specialty markings. Markings 10 are designed for high urban traffic volumes and severe wear and will not deteriorate due to exposure to sunlight, oil, gasoline, water, salt, or pavement oil content. Preformed marking 10 preferably conform to the pavement contours. Marking 10 preferably has resealing characteristics and is capable of fusing to itself and previously applied worn hydrocarbon and alkyd thermoplastic.

In a non-limiting exemplary embodiment, the configurations of the preformed thermoplastic line marking preferably conform to the current Manual of Uniform Traffic Control Devices for Street and highways as issued by the U.S.A. Federal Highway Administration. The markings are preferably a resilient white or colored thermoplastic product with uniformly distributed glass beads on the surface and throughout the entire cross section of the material.

In a non-limiting exemplary embodiment, preformed thermoplastic line marking 10 preferably includes an alkyd modified ester rosin that will not be deteriorated by gas or oil. In addition, the material contains aggregates, pigments, binders and glass beads which may be factory produced as a finished product. Some markings, such as arrows, are preferably produced without beads for directional purposes and receive drop-on beads during installation. The thermoplastic material preferably conforms to, or exceeds, AASHTO designation M249, except for the relevant differences due to the material being supplied in a preformed state.

In a non-limiting exemplary embodiment, thermoplastic lower substrate layer 11 of the preformed thermoplastic line marking 10 should be heated until it has reached a molten state (fusible liquid), typically at about 350° F.-375° F. (177° C.-191° C.). Lower substrate layer 11 will appear to be shiny. The edges will relax and slant downward. Small bubbles and/or steam can be visible. Lower substrate layer 11 is completely conformed to the roadway surface. During normal application, lower substrate layer 11 preferably does not mar or discolor and/or turn brown. All the above signify that a satisfactory adhesion and proper bead embedment has been achieved. The top side of lower substrate layer 11, where the top beads are located, preferably has factory-applied heat indicators to assist the applicator in determining when the material has reached proper application temperature.

In a non-limiting exemplary embodiment, upper layer 12 of preformed thermoplastic line marking 10 can be provided with a properly applied and embedded top dressing, which preferably provides a minimum skid resistance value of 35 BPN when tested according to ASTM: E 303. High skid material available when required and preferably exceeds 45, and 55 BPN accordingly.

In a non-limiting exemplary embodiment, a width of the preformed thermoplastic line marking preferably has a minimum average thickness of either: 0.090 mils (2.286 mm) or 0.125 mils (3.15 mm) as required.

In a non-limiting exemplary embodiment, the turn arrows and combination arrows may be available without retro-reflective glass bead toppings. This allows for reduction of inventory and last-minute job changes when required.

In a non-limiting exemplary embodiment, preformed thermoplastic line marking 10 is resistant to deterioration exposure to water, sunlight, adverse weather conditions and is impervious to oil and gasoline.

In a non-limiting exemplary embodiment, preformed thermoplastic line marking 10 preferably, upon application, exhibits uniform adequate nighttime reflectivity. Using a Zehntner retro-reflectometer or approved equal, with a 30-meter geometry, and tested in accordance to ASTM E. Preformed thermoplastic line marking preferably 10 is preferably capable of exceeding a retro-reflectivity value of 450 millicandelas for white and 350 millicandelas for yellow. It is noted that the retro-reflection can vary greatly during installation depending on the amount of heat applied during installation. Broadcasting beads during or after application may be permitted providing it meets all requirements.

In a non-limiting exemplary embodiment, prior to application, preformed thermoplastic line marking 10 preferably remains flexible at temperatures above 40° F. (4.4° C.) and preferably is fusible to asphalt concrete by the normal heat of a propane type torch or other suitable heating apparatus. In addition, the preformed thermoplastic material is preferably capable of being handled without breaking in temperatures as low as 40° F. (4.4° C.). The recommended torch type preferably has a rating in the range of about 210,000 to 600,000 BTU's.

In a non-limiting exemplary embodiment, all moisture is preferably completely removed from the substrate and the surface is preferably totally free of loose or chipping debris. A primer is recommended for aged or difficult to bond surfaces like smooth, non-porous cement.

In a non-limiting exemplary embodiment, on most surfaces, preformed thermoplastic line marking 10 is capable of being applied as the original permanent marking on the day the surface is paved without being adversely affected by the fresh pavement oil content. If excessive oil is present on top, it should be removed.

In a non-limiting exemplary embodiment, the following tools and equipment are preferred for proper installation of preformed thermoplastic line marking 10: broom or powered blower; all required safety clothing, including vest; chalk stick, spray paint, or snap line for layout; full 40 pound propane tank—small 20 pound tanks tend to freeze up prematurely; infrared thermometer; tape measure and razor knife; application torch capable of producing at least 250, 000 BTU's, regulator and a 30+ foot hose.

In a non-limiting exemplary embodiment, storing and handling of preformed thermoplastic line marking 10 should be kept in the original package until arrival on a job site and ready to install. This will prevent damage and loss of any parts. If it is necessary to store preformed thermoplastic line marking 10, then it should preferably be stored indoors if at all possible. Otherwise, if outside, material must be under cover and protected from weather. Boxes of preformed thermoplastic line marking should be stored flat and stacked no higher than 20 boxes high. When transporting preformed thermoplastic line marking 10, pallets should not be stacked on top of pallets or boxes or breakage could occur. The preformed thermoplastic line marking should not be transported in temperatures below 33° F. (0.6° C.) or over 105° F. (41° C.).

In a non-limiting exemplary embodiment, preformed thermoplastic line marking 10 can be used on new asphalt as soon as it has cooled to the touch. Preformed thermoplastic line marking 10 can also be installed on Portland cement concrete; however, new concrete should cure for a minimum of 45 days before application. A primer/sealer is not required for most applications. However, extra care should be taken to check bonding after preformed thermoplastic line marking 10 has cooled. It is preferred to use a primer for extremely old asphalts or smooth concrete surfaces. When concrete curing agents or old chipping/flaking markings are present, they should be thoroughly removed (via e.g., a water blaster, sand blaster, or scarifier) prior to installation of preformed thermoplastic line marking 10.

In a non-limiting exemplary embodiment, preformed thermoplastic line marking 10 should not be installed over existing paint or old thermoplastic that is chipping/flaking or oxidized. It is acceptable to heat existing thermoplastic and apply preformed thermoplastic line marking 10 as long as loose and oxidized material has been removed. Surface preparation is extremely important when installing preformed thermoplastic line marking 10. The surface area should preferably be, to the extent reasonably possible, clean and free of debris, chemicals, including curing agents. Oils, and other previously marked materials, such as paint, thermoplastic, and other preformed materials, should be removed from the installation area. The installation area should preferably, to the extent reasonably possible, also be completely dry, with no moisture present. Preformed thermoplastic line marking 10 should preferably not be applied within two days after a rain. During installation of preformed thermoplastic line marking 10, if moisture is present, a torch should be used to evaporate the moisture, until surface area is fully dry.

In a non-limiting exemplary embodiment, a recommended torch may be a Magnum Torch with a 33-foot hose. When setting the torch regulator, it is not necessary to press leaver, just adjust regulator so valve is approximately two-thirds open. The torch should be at least six inches above lower substrate layer 11. If lower substrate layer 11 splatters, the torch nozzle is too close to the material or the pilot valve needs to be reduced.

In a non-limiting exemplary embodiment, if the surface area is heated to over 212° F. (100° C.) to remove moisture, it should not be heated until after a layout has been made showing, e.g., in outline form, where the lower substrate layer 11 will be placed. Preferably after, but optionally before, surface preparation is complete, spray paint or chalk may be used to mark the layout. For legends, a chalk line should be snapped where the horizontal center of the legend is to be positioned. Material sections should be situated on the guide-line and its outline traced to provide a template. For a quicker installation, the surface should be heated. Energy is best utilized where the bond is to take place, ensuring less bonding failures and virtually eliminating unseen subsurface moisture. Once sections are outlined, the preformed sections are removed, and the area encompassing the layout is heated until material is in a molten state, typically at approximately 350° F.-375° F. (177° C.-191° C.). Proper heating is done when the torch head is approximately 12 inches above the surface, and the torch is constantly moving in a circular or back and forth, sweeping motion. As an asphalt surface is heated, the asphalt should become darker and tacky, which will be an additional aid in bonding and an indicator that an appropriate temperature has been reached. For older asphalt or concrete, it is recommended that a temperature gun be used to determine a temperature of approximately 300° F. (149° C.).

In a non-limiting exemplary embodiment, sections should preferably be immediately put in place and heating should continue over preformed thermoplastic line marking 10 in an approximately 2 foot×4 foot (60 cm×120 cm) area. The torch should preferably be kept at least 6 inches (15 cm) above the material, preferably keeping the torch moving as not to burn material. The material should start to conform to the surface and fill in the crevasses. Once the material has become fully molten, or liquefied, the initial installation is complete. The installation should be inspected after preformed thermoplastic line marking 10 has cooled to ambient temperature, but before leaving the job site, for bonding and reflectivity. Bonding can easily be checked by taking a putty knife and lifting up the markings around the edge. If markings can be lifted up easily without asphalt/concrete film showing on the underside, a bond has not been established because the material did not receive enough heat to become molten; enabling the bond (this is similar to using a glue gun, i.e., if hot and tacky it will stick, but if cooled too much, there will be no tack and no bond). Additionally, reflectivity of markings should be checked with a retro-reflectometer. If one is not available and the sun is out, stand facing away from the sun and toward the markings, looking for the sun's light. If initial reflectivity is poor, type one highway beads are easily able to be hand casted, insuring that markings have adequate immediate reflectivity. For optimal reflectivity, glass beads should preferably be 50-60% embedded.

In a non-limiting exemplary embodiment, preformed thermoplastic line marking 10 can be installed on old or new, asphalt and concrete as discussed above. Installation can also be accomplished on cobble stone or brick surfaces as well, though it is recommended that installation on a test area be done first. Preformed thermoplastic line markings 10 can be readily retrofitted by cutting with a knife, heavy duty scissors, or the like. Any seams will be virtually invisible after proper heating. All dirt/debris and moisture should preferably be removed before installation of preformed thermoplastic line markings 10. Reversible (i.e., un-beaded) preformed thermoplastic line marking 10 standard DOT arrows can be ordered to help ensure that left and right arrows are always in stock. Preformed thermoplastic line marking 10 are preferably made in 24 inch×36 inch (60 cm×120 cm) perforated strips, and preferably utilize as 4, 8, 12, 16, or 24 inch (10, 20, 30, 40, or 60 cm) flats. It is noted that some newer asphalt mixtures (e.g., newer emulsion systems) may need to be laid in place for at least three months before applying any thermoplastic material.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, nor is it intended to be limiting as to the scope of the disclosure in any way.

While the disclosure has been described with respect to certain specific embodiment(s), it will be appreciated that many modifications and changes may be made by those skilled in the art without departing from the spirit of the disclosure. It is intended, therefore, by the description hereinabove to cover all such modifications and changes as fall within the true spirit and scope of the disclosure. In particular, with respect to the above description, it is to be realized that the optimum dimensional relationships for the parts of the exemplary embodiment(s) may include variations in size, materials, shape, form, function and manner of operation.

The invention claimed is:

1. A preformed thermoplastic roadway line marking comprising:

a preformed thermoplastic substrate layer capable of adhering to a roadway;

a preformed thermoplastic upper layer in contact with the preformed thermoplastic substrate layer, the preformed thermoplastic upper layer including a surface area having a plurality of slits spaced therealong;

wherein the slits penetrate through an entire cross-sectional thickness of the preformed thermoplastic upper layer and are in fluid communication with the preformed thermoplastic substrate layer; and wherein the preformed thermoplastic substrate layer has a morphed shape and is at least partially displaced upwardly through the slits and disposed on the preformed thermoplastic upper layer such that the preformed thermoplastic upper layer is fixedly locked to the preformed thermoplastic substrate layer and maintained at a substantially stable position relative to the preformed thermoplastic substrate layer.

2. The preformed thermoplastic roadway line marking of claim 1, wherein the preformed thermoplastic upper layer has a non-morphed predetermined shape.

3. The preformed thermoplastic roadway line marking of claim 1, wherein the slits comprise a rectilinear slit.

4. The preformed thermoplastic roadway line marking of claim 1, wherein the slits comprise an arcuate slit.

5. The preformed thermoplastic roadway line marking of claim 1, wherein the preformed thermoplastic upper layer further comprises an aperture juxtaposed adjacent to the slits.

6. The preformed thermoplastic roadway line marking of claim 1, wherein the preformed thermoplastic upper layer further comprises an aperture juxtaposed adjacent to the slits, and wherein the preformed thermoplastic roadway line marking further comprises an image layer affixed to the preformed thermoplastic substrate layer and seated within the aperture.

7. The preformed thermoplastic roadway line marking of claim 1, wherein the preformed thermoplastic upper layer further comprises an aperture juxtaposed adjacent to the slits, wherein the preformed thermoplastic roadway line marking further comprises an image layer affixed to the preformed thermoplastic substrate layer and seated within the aperture; and wherein the image layer is one of a uni-directional image layer and a bi-directional image layer.

8. The preformed thermoplastic roadway line marking of claim 1, wherein the preformed thermoplastic upper layer further comprises an aperture juxtaposed adjacent to the slits; and wherein the slits are arranged in a desired configuration and surround the aperture.

9. The preformed thermoplastic roadway line marking of claim 1, wherein at least one of the preformed thermoplastic substrate layer and the preformed thermoplastic upper layer comprises: a plurality of retro-reflective glass beads.

10. The preformed thermoplastic roadway line marking of claim 1, wherein the preformed thermoplastic upper layer has a planar top surface.

11. The preformed thermoplastic roadway line marking of claim 1, wherein the preformed thermoplastic upper layer has a non-planar top surface.

12. The preformed thermoplastic roadway line marking of claim 1;

wherein the preformed thermoplastic upper layer has a non-planar top surface; and wherein the non-planar top surface comprises: at least one pattern selected from a group including a hatching pattern, a corrugated pattern, a sinusoidal pattern, and a ribbed pattern.

13. The preformed thermoplastic roadway line marking of claim 1;

wherein the preformed thermoplastic upper layer has a non-planar top surface; and wherein the preformed thermoplastic substrate layer is thermally bonded to the preformed thermoplastic upper layer.

14. The preformed thermoplastic roadway line marking of claim 1, wherein the preformed thermoplastic upper layer further comprises: a heat stabilizing agent.

15. A method for installing a preformed thermoplastic roadway line marking, the method comprising the steps of:

providing and attaching a preformed thermoplastic substrate layer to a roadway by heating the preformed thermoplastic substrate layer to a liquid state such that the preformed thermoplastic substrate layer has a morphed shape;

providing and contacting a preformed thermoplastic upper layer with the preformed thermoplastic substrate layer, the preformed thermoplastic upper layer including a surface area having a plurality of spaced slits, wherein the slits penetrate through an entire cross-sectional thickness of the preformed thermoplastic upper layer;

applying a downward external force on the preformed thermoplastic upper layer such that the slits are in fluid communication with the liquid state of the preformed thermoplastic substrate layer; and fixedly locking the preformed thermoplastic upper layer to the preformed thermoplastic substrate layer and maintaining the preformed thermoplastic upper layer at a substantially stable position relative to the preformed thermoplastic substrate layer by at least partially displacing upwardly the morphed shape of the preformed thermoplastic substrate layer through the slits and thereby disposing the morphed shape of the preformed thermoplastic substrate layer on the preformed thermoplastic upper layer.

* * * * *